US012313310B2

(12) United States Patent
Ikari et al.

(10) Patent No.: US 12,313,310 B2
(45) Date of Patent: May 27, 2025

(54) REFRIGERANT FLOW PATH SWITCHING DEVICE AND AIR CONDITIONING SYSTEM

(71) Applicant: DAIKIN INDUSTRIES, LTD., Osaka (JP)

(72) Inventors: Kazuki Ikari, Osaka (JP); Naoyuki Ohta, Osaka (JP); Hiroyuki Imada, Osaka (JP); Junichi Shimoda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 462 days.

(21) Appl. No.: 17/694,961

(22) Filed: Mar. 15, 2022

(65) Prior Publication Data

US 2022/0205693 A1 Jun. 30, 2022

Related U.S. Application Data

(63) Continuation of application No. PCT/JP2020/033373, filed on Sep. 3, 2020.

(30) Foreign Application Priority Data

Sep. 24, 2019 (JP) ..... 2019-172427

(51) Int. Cl.
*F25B 41/26* (2021.01)
*F25B 5/02* (2006.01)
*F25B 13/00* (2006.01)

(52) U.S. Cl.
CPC ..... *F25B 41/26* (2021.01); *F25B 5/02* (2013.01); *F25B 13/00* (2013.01);
(Continued)

(58) Field of Classification Search
CPC .. F25B 41/26; F25B 41/42; F25B 5/02; F25B 41/20; F25B 49/02; F25B 2313/027; F24F 1/32; F24F 1/34
See application file for complete search history.

(56) References Cited

U.S. PATENT DOCUMENTS

2009/0049855 A1* 2/2009 Murata ..... F24F 1/34 29/890.03
2016/0377332 A1* 12/2016 Eguchi ..... F25B 41/20 62/324.6

FOREIGN PATENT DOCUMENTS

JP 2015-114049 A 6/2015

OTHER PUBLICATIONS

English Translation of International Preliminary Report on Patentability issued in corresponding International Application No. PCT/JP2020/033373 dated Mar. 15, 2022 (4 pages).
(Continued)

*Primary Examiner* — Frantz F Jules
*Assistant Examiner* — Webeshet Mengesha
(74) *Attorney, Agent, or Firm* — Osha Bergman Watanabe & Burton LLP

(57) ABSTRACT

A refrigerant flow path switching device includes: a first header pipe that is connected to a high-and-low-pressure gas connection pipe of a heat source unit in an air conditioner; a second header pipe that is connected to a sucked-gas connection pipe of the heat source unit; a third header pipe that is connected to a liquid connection pipe of the heat source unit; switching units that each correspond respectively to utilization units in the air conditioner and include valves that control refrigerant flows; and a casing accommodating the first header pipe, the second header pipe, the third header pipe, and switching units. The refrigerant flow path switching device switches among refrigerant flow paths, each of which is between the heat source unit and one of the utilization units.

10 Claims, 10 Drawing Sheets

(52) U.S. Cl.
CPC . *F25B 2313/02732* (2013.01); *F25B 2400/13* (2013.01); *F25B 2600/2513* (2013.01); *F25B 2600/2519* (2013.01)

(56) References Cited

OTHER PUBLICATIONS

Extended European search report issed in corresponding European Patent Application No. 20868582.6 dated Sep. 28, 2022 (5 pages).
International Search Report issued in corresponding International Application No. PCT/JP2020/033373 mailed Nov. 17, 2020 (2 pages).

* cited by examiner

REFRIGERANT FLOW PATH SWITCHING DEVICE AND AIR CONDITIONING SYSTEM

TECHNICAL FIELD

The present disclosure relates to a refrigerant flow path switching device and an air conditioning system.

BACKGROUND

There has been known a refrigerant flow path switching device configured to switch, in an air conditioner including a heat source unit and a plurality of utilization units, among refrigerant flow paths between the heat source unit and the plurality of utilization units, for individual switching between cooling operation and heating operation at each of the utilization units (see PATENT LITERATURE 1 or the like). The refrigerant flow path switching device described in PATENT LITERATURE 1 includes a first header pipe connected to a high and low-pressure gas connection pipe of the heat source unit, a second header pipe connected to a sucked gas connection pipe of the heat source unit, a third header pipe connected to a liquid connection pipe of the heat source unit, a plurality of switching units provided correspondingly to the utilization units and including a plurality of valves for switching among the refrigerant flow paths, and a casing accommodating the first to third header pipes and the plurality of switching units. The first to third header pipes connected to the connection pipes have end parts each projecting outward from a side surface of the casing.

Patent Literature

PATENT LITERATURE 1: Japanese Laid-Open Patent Publication No. 2015-114049

SUMMARY (1) A refrigerant flow path switching device according to one or more embodiments includes a first header pipe connectable to a high and low-pressure gas connection pipe of a heat source unit in an air conditioner, a second header pipe connectable to a sucked gas connection pipe of the heat source unit, a third header pipe connectable to a liquid connection pipe of the heat source unit, a switching unit provided correspondingly to each of a plurality of utilization units in the air conditioner and including a plurality of valves each configured to control a refrigerant flow, and a casing accommodating the first header pipe, the second header pipe, the third header pipe, and the switching unit, the refrigerant flow path switching device configured to switch among refrigerant flow paths between the heat source unit and the plurality of utilization units, in which the first header pipe, the second header pipe, and the third header pipe have end parts projecting outward from the casing and aligned linearly in a first direction, and the plurality of valves in the switching unit is disposed apart from the end part of the first header pipe in a second direction perpendicular to the first direction and a direction in which the end part extends.

(2) The present disclosure provides an air conditioning system including: an air conditioner having a heat source unit and a plurality of utilization units; and the refrigerant flow path switching device according to the section (1).

DETAILED DESCRIPTION

An air conditioning system according to the present disclosure will be described in detail hereinafter with reference to the accompanying drawings. The present disclosure should not be limited to the following exemplification, but is intended to include any modification recited in the claims within meanings and a scope equivalent to the scope of the claims.

Figure 1:
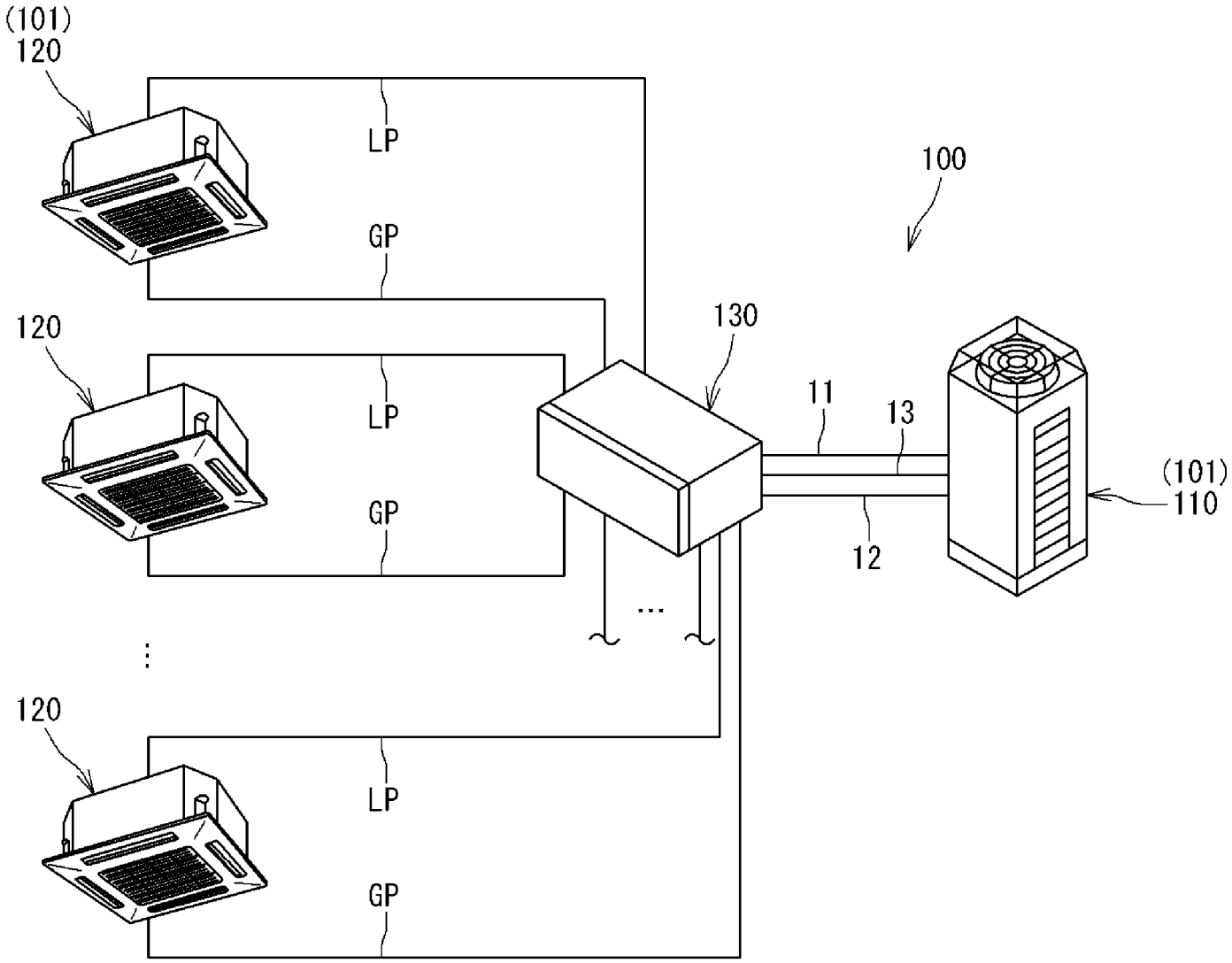
FIG. 1 depicts an entire configuration of an air conditioning system according to one or more embodiments of the present disclosure.

FIG. 1 depicts an entire configuration of an air conditioning system according to one or more embodiments of the present disclosure.

An air conditioning system 100 is installed in a building, a plant, or the like and achieves air conditioning in an air conditioning target space. The air conditioning system 100 includes an air conditioner 101 and a refrigerant flow path switching device 130. The air conditioner 101 is configured to execute vapor-compression refrigeration cycle operation to cool or heat the air conditioning target space.

The air conditioner 101 includes an outdoor unit 110 as a heat source unit and at least one indoor unit 120 as a utilization unit. In the air conditioner 101, a plurality of indoor units 120 is connected to the single outdoor unit 110 via the refrigerant flow path switching device 130. In the air conditioner 101, the refrigerant flow path switching device 130 is configured to freely select cooling operation or heating operation for each of the indoor units 120.

[Configuration of Outdoor Unit]

Figure 2:
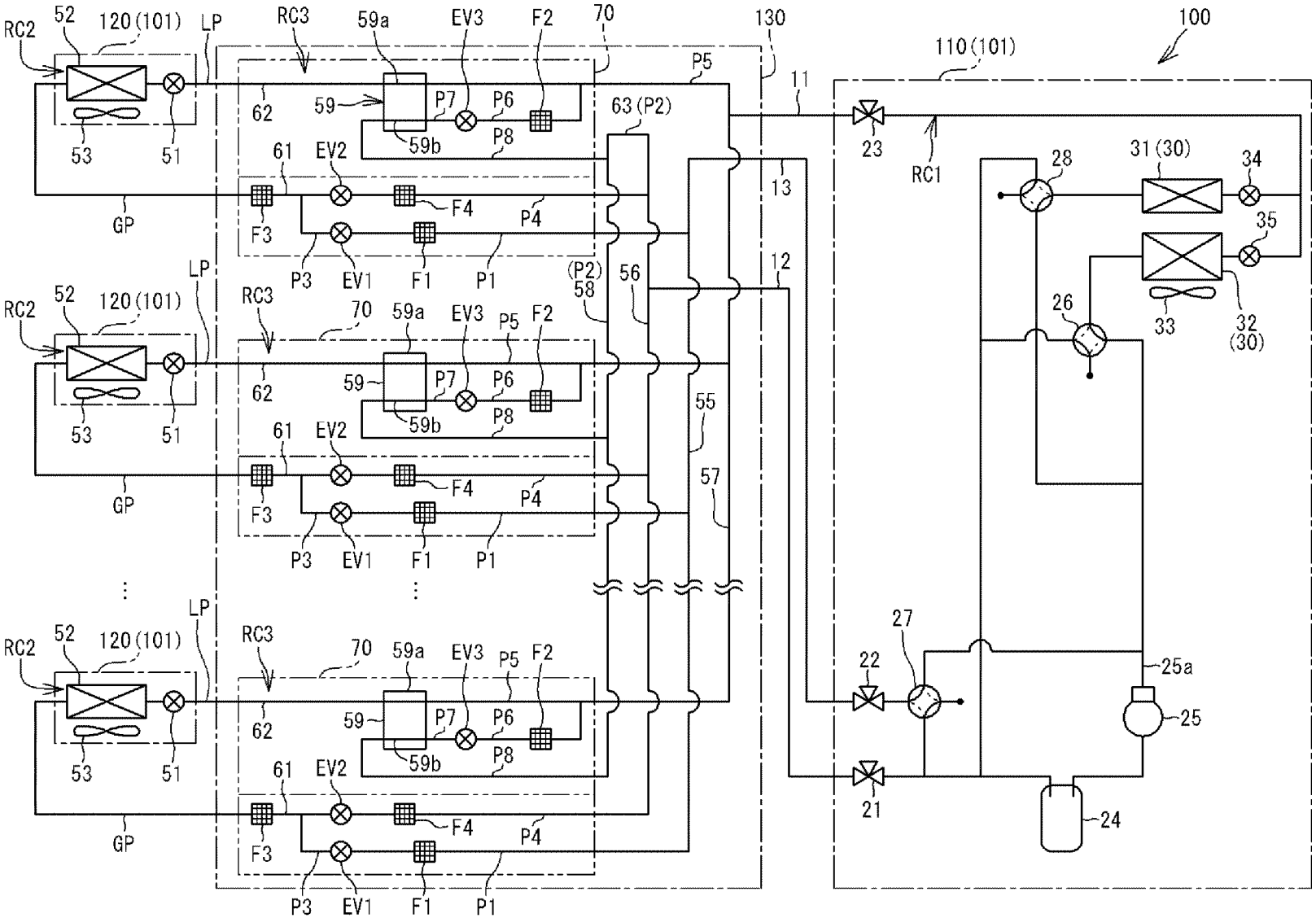
FIG. 2 is a refrigerant circuit diagram of the air conditioning system.

FIG. 2 is a refrigerant circuit diagram of the air conditioning system.

The outdoor unit 110 is installed outdoors such as on a roof or a balcony of a building, or underground.

The outdoor unit 110 is provided therein with various constituents that are connected via refrigerant pipes to constitute a heat source refrigerant circuit RC1. The heat source refrigerant circuit RC1 is connected to a refrigerant circuit RC3 in the refrigerant flow path switching device 130 via a liquid connection pipe 11, a sucked gas connection pipe (i.e., sucked-gas connection pipe) 12, and a high and low-pressure gas connection pipe (i.e., high-and-low-pressure gas connection pipe) 13.

The heat source refrigerant circuit RC1 includes a gas-side first shutoff valve 21, a gas-side second shutoff valve 22, a liquid-side shutoff valve 23, an accumulator 24, a compressor 25, a first flow path switching valve 26, a second flow path switching valve 27, a third flow path switching valve 28, an outdoor heat exchanger 30, a first outdoor expansion valve 34, and a second outdoor expansion valve 35. The heat source refrigerant circuit RC1 is constituted by these constituents connected via a plurality of refrigerant pipes. The outdoor unit 110 is provided therein with an outdoor fan 33, a control unit (not depicted), and the like.

The gas-side first shutoff valve 21, the gas-side second shutoff valve 22, and the liquid-side shutoff valve 23 are manually opened and closed upon refrigerant filling, pump down, and the like. The gas-side first shutoff valve 21 has a first end connected to the sucked gas connection pipe 12. The gas-side first shutoff valve 21 has a second end connected to a refrigerant pipe extending to reach the accumulator 24.

The gas-side second shutoff valve 22 has a first end connected to the high and low-pressure gas connection pipe 13. The gas-side second shutoff valve 22 has a second end connected to a refrigerant pipe extending to reach the second flow path switching valve 27.

The liquid-side shutoff valve 23 has a first end connected to the liquid connection pipe 11. The liquid-side shutoff valve 23 has a second end connected to a refrigerant pipe extending to reach the first outdoor expansion valve 34 and the second outdoor expansion valve 35.

The accumulator 24 is a reservoir temporarily storing a low-pressure refrigerant to be sucked into the compressor 25 for separation between a gas refrigerant and a liquid refrigerant.

The compressor 25 has a hermetic structure incorporating a compressor motor, and is of a positive-displacement type such as a scroll type or a rotary type. The compressor 25 compresses a sucked low-pressure refrigerant and then discharges the compressed refrigerant from a discharge pipe 25*a*. The compressor 25 contains refrigerating machine oil. This refrigerating machine oil occasionally circulates in a refrigerant circuit along with the refrigerant. The outdoor unit 110 according to one or more embodiments includes a single compressor 25. The outdoor unit 110 may alternatively include two or more compressors 25 connected in parallel.

The first flow path switching valve 26, the second flow path switching valve 27, and the third flow path switching valve 28 are four-way switching valves. Each of the first flow path switching valve 26, the second flow path switching valve 27, and the third flow path switching valve 28 switches a refrigerant flow in accordance with an operation situation of the air conditioner 101. Each of the first flow path switching valve 26, the second flow path switching valve 27, and the third flow path switching valve 28 has a refrigerant inflow port connected to the discharge pipe 25*a* or a branching pipe extending from the discharge pipe 25*a*.

The first flow path switching valve 26, the second flow path switching valve 27, and the third flow path switching valve 28 are configured to shut off a refrigerant flow in a refrigerant flow path during operation, and actually function as three-way valves.

The outdoor heat exchanger 30 is of a cross-fin type or a microchannel type. The outdoor heat exchanger 30 includes a first heat exchange unit 31 and a second heat exchange unit 32. The first heat exchange unit 31 is provided in an upper portion of the outdoor heat exchanger 30, and the second heat exchange unit 32 is provided below the first heat exchange unit 31.

The first heat exchange unit 31 has a gas side end connected to a refrigerant pipe extending to reach the third flow path switching valve 28. The first heat exchange unit 31 has a liquid side end connected to a refrigerant pipe extending to reach the first outdoor expansion valve 34.

The second heat exchange unit 32 has a gas side end connected to a refrigerant pipe extending to reach the first flow path switching valve 26. The second heat exchange unit 32 has a liquid side end connected to a refrigerant pipe extending to reach the second outdoor expansion valve 35.

The refrigerant passing through the first heat exchange unit 31 and the second heat exchange unit 32 exchanges heat with an air flow generated by the outdoor fan 33. The outdoor fan 33 is a propeller fan or the like, and is driven by an outdoor fan motor (not depicted). The outdoor fan 33 generates an air flow flowing into the outdoor unit 110, passing through the outdoor heat exchanger 30, and flowing out of the outdoor unit 110.

Examples of the first outdoor expansion valve 34 and the second outdoor expansion valve 35 include a motor operated valve having an adjustable opening degree. The first outdoor expansion valve 34 has a first end connected to a refrigerant pipe extending from the first heat exchange unit 31. The first outdoor expansion valve 34 has a second end connected to a refrigerant pipe extending to reach the liquid-side shutoff valve 23.

The second outdoor expansion valve 35 has a first end connected to a refrigerant pipe extending from the second heat exchange unit 32. The second outdoor expansion valve 35 has a second end connected to a refrigerant pipe extending to reach the liquid-side shutoff valve 23. Each of the first outdoor expansion valve 34 and the second outdoor expansion valve 35 has an opening degree adjusted in accordance with an operation situation, and decompresses the refrigerant passing through the outdoor expansion valve in accordance with the opening degree.

The compressor 25, the outdoor fan 33, the first outdoor expansion valve 34, the second outdoor expansion valve 35, the first flow path switching valve 26, the second flow path switching valve 27, and the third flow path switching valve 28 are operation controlled by the control unit (not depicted). The control unit in the outdoor unit 110 is a microcomputer including a CPU, a memory, and the like. The control unit in the outdoor unit 110 transmits and receive signals to and from a control unit in the indoor unit 120 and a control unit in the refrigerant flow path switching device 130 via communication lines.

[Configuration of Indoor Unit]

The indoor unit 120 is of a ceiling embedded type, a ceiling pendant type, a floorstanding type, or a wall mounted type. The air conditioning system 100 according to one or more embodiments exemplarily includes four indoor units 120.

The indoor unit 120 is provided therein with a utilization refrigerant circuit RC2. The utilization refrigerant circuit RC2 includes an indoor expansion valve 51 and an indoor heat exchanger 52. The utilization refrigerant circuit RC2 is constituted by the indoor expansion valve 51 and the indoor heat exchanger 52 connected via a refrigerant pipe.

The indoor unit 120 is provided therein with an indoor fan 53 and the control unit (not depicted).

The indoor expansion valve 51 is a motor operated valve having an adjustable opening degree. The indoor expansion valve 51 has a first end connected to a liquid tube LP. The indoor expansion valve 51 has a second end connected to a refrigerant pipe extending to reach the indoor heat exchanger 52. The indoor expansion valve 51 decompresses the refrigerant passing therethrough in accordance with the opening degree.

The indoor heat exchanger 52 is of a cross-fin type, a microchannel type, or the like. The indoor heat exchanger 52 has a liquid side end connected to a refrigerant pipe extending from the indoor expansion valve 51. The indoor heat exchanger 52 has a gas side end connected to a gas tube GP. The refrigerant having flowed into the indoor heat exchanger 52 exchanges heat with an air flow generated by the indoor fan 53 and is exhausted from the indoor heat exchanger 52.

Examples of the indoor fan 53 include a cross-flow fan and a sirocco fan. The indoor fan 53 is driven by an indoor fan motor (not depicted). The indoor fan 53 generates an air flow flowing from an indoor space into the indoor unit 120, passing through the indoor heat exchanger 52, and then flowing out to the indoor space.

The indoor expansion valve 51 and the indoor fan 53 are operation controlled by the control unit (not depicted) in the indoor unit 120. The control unit in the indoor unit 120 is a microcomputer including a CPU, a memory, and the like. The control unit in the indoor unit 120 is connected with a remote controller (not depicted). The control unit in the indoor unit 120 drives the indoor fan 53 and the indoor expansion valve 51 in accordance with operating conditions such as set temperature inputted to the remote controller.

[Configuration of Refrigerant Flow Path Switching Device]

The refrigerant flow path switching device 130 is provided between the outdoor unit 110 and the plurality of indoor units 120. The refrigerant flow path switching device 130 switches flows of the refrigerant entering the outdoor unit 110 and the indoor units 120.

Figure 3:
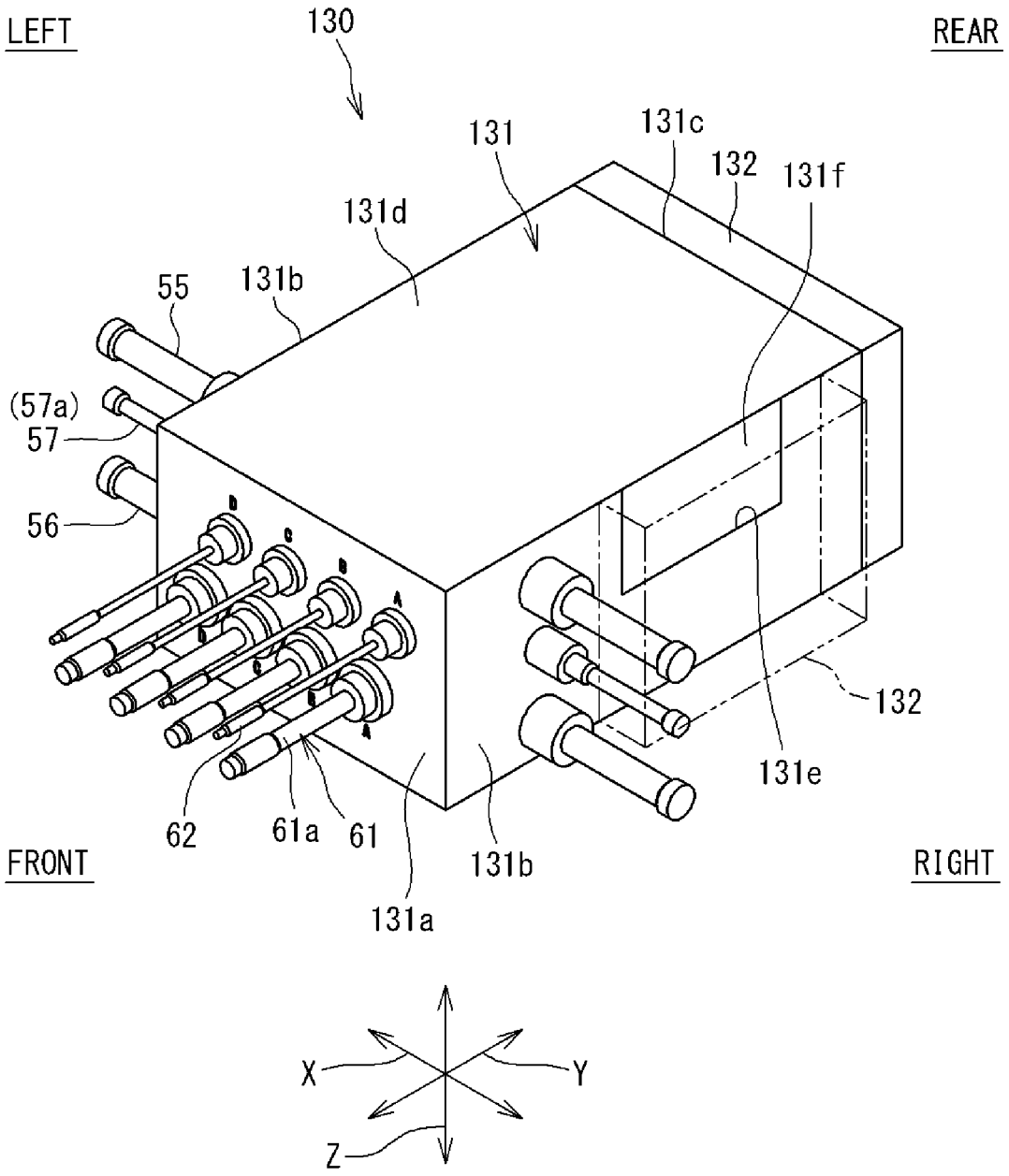
FIG. 3 is a perspective view of a refrigerant flow path switching device.
Figure 4:
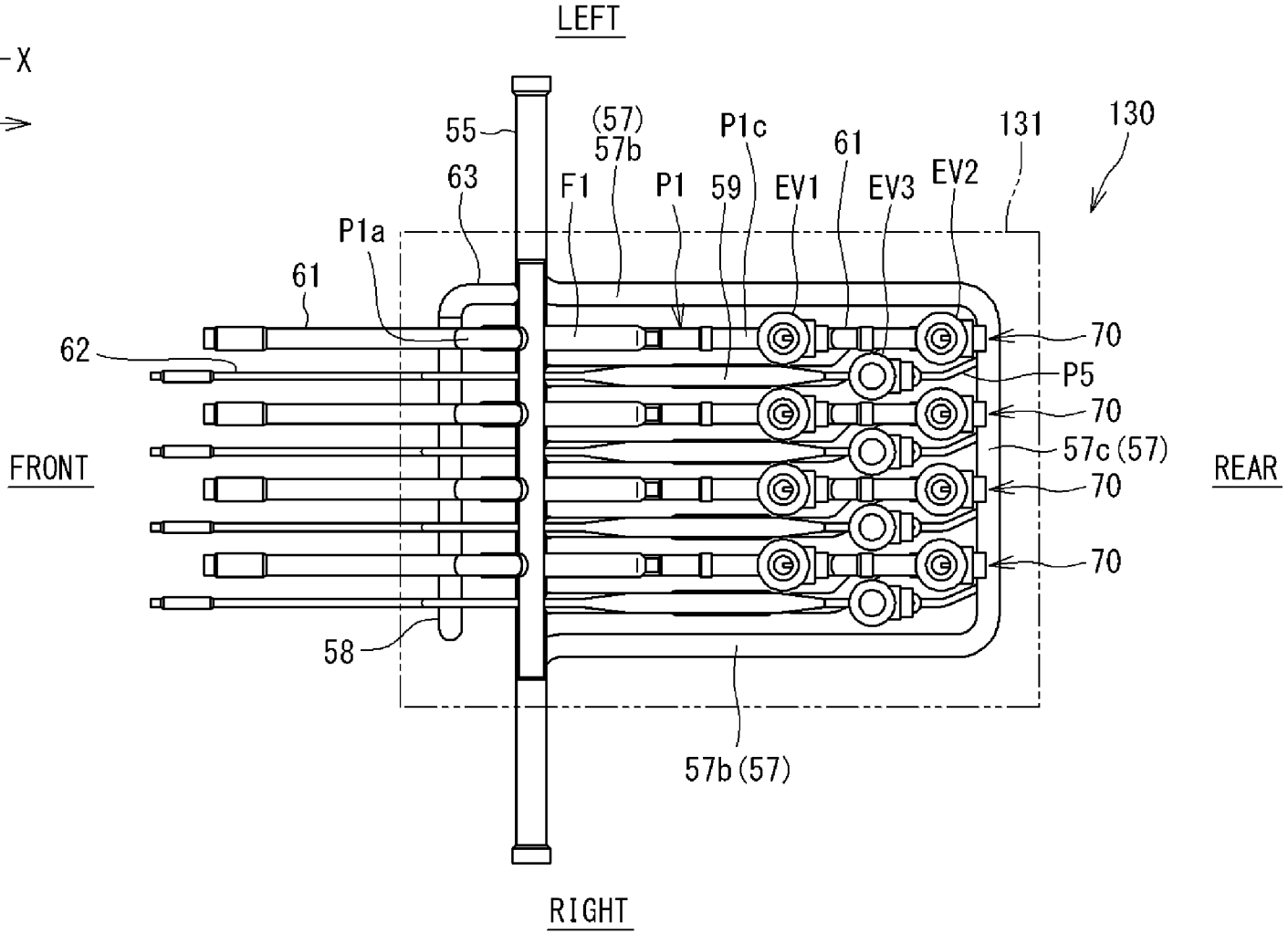
FIG. 4 is a plan view depicting an internal configuration of the refrigerant flow path switching device.
Figure 4:
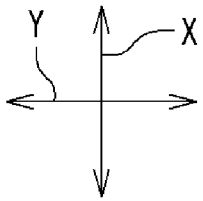
Figure 5:
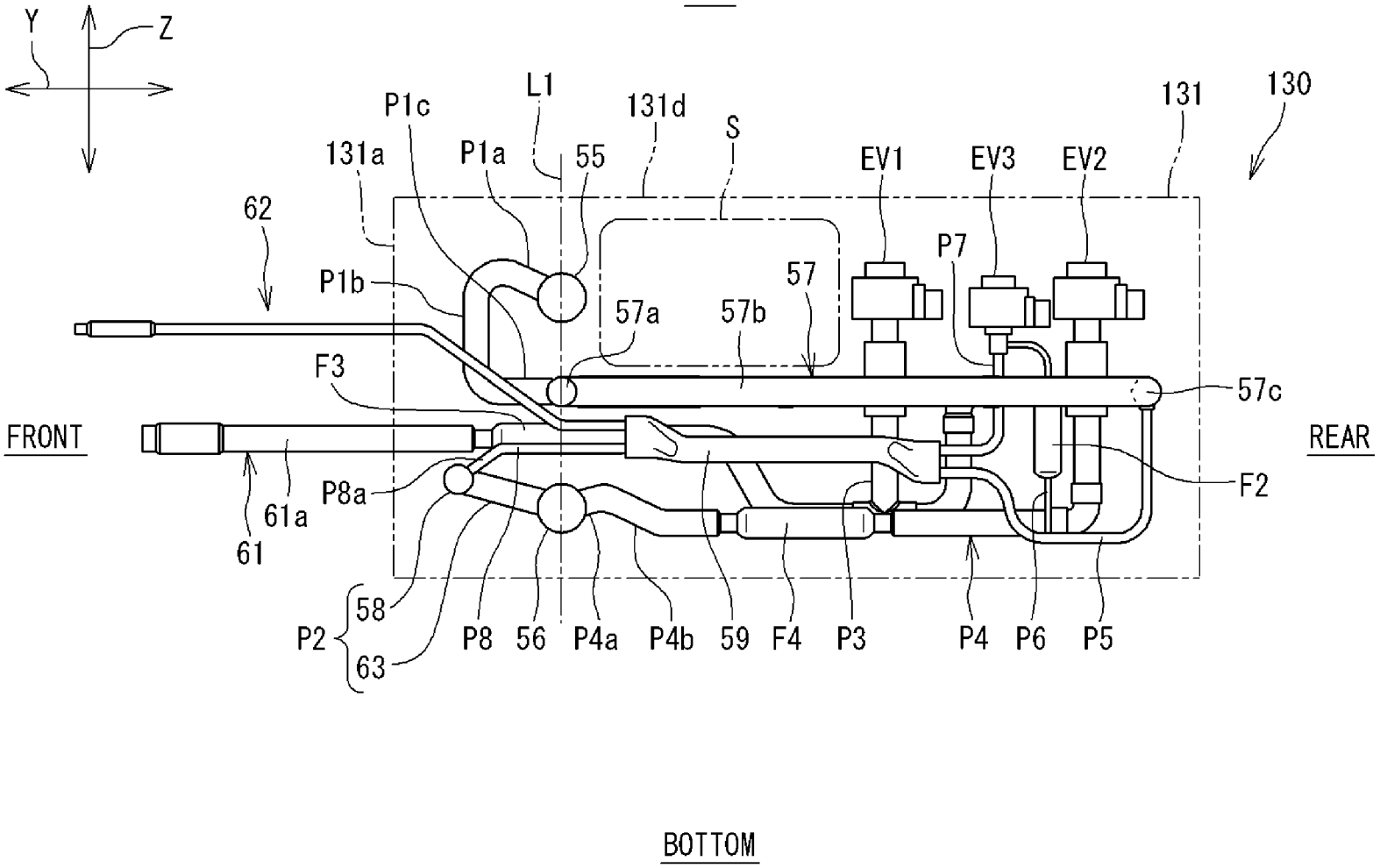
FIG. 5 is a side view depicting the internal configuration of the refrigerant flow path switching device.
Figure 6:
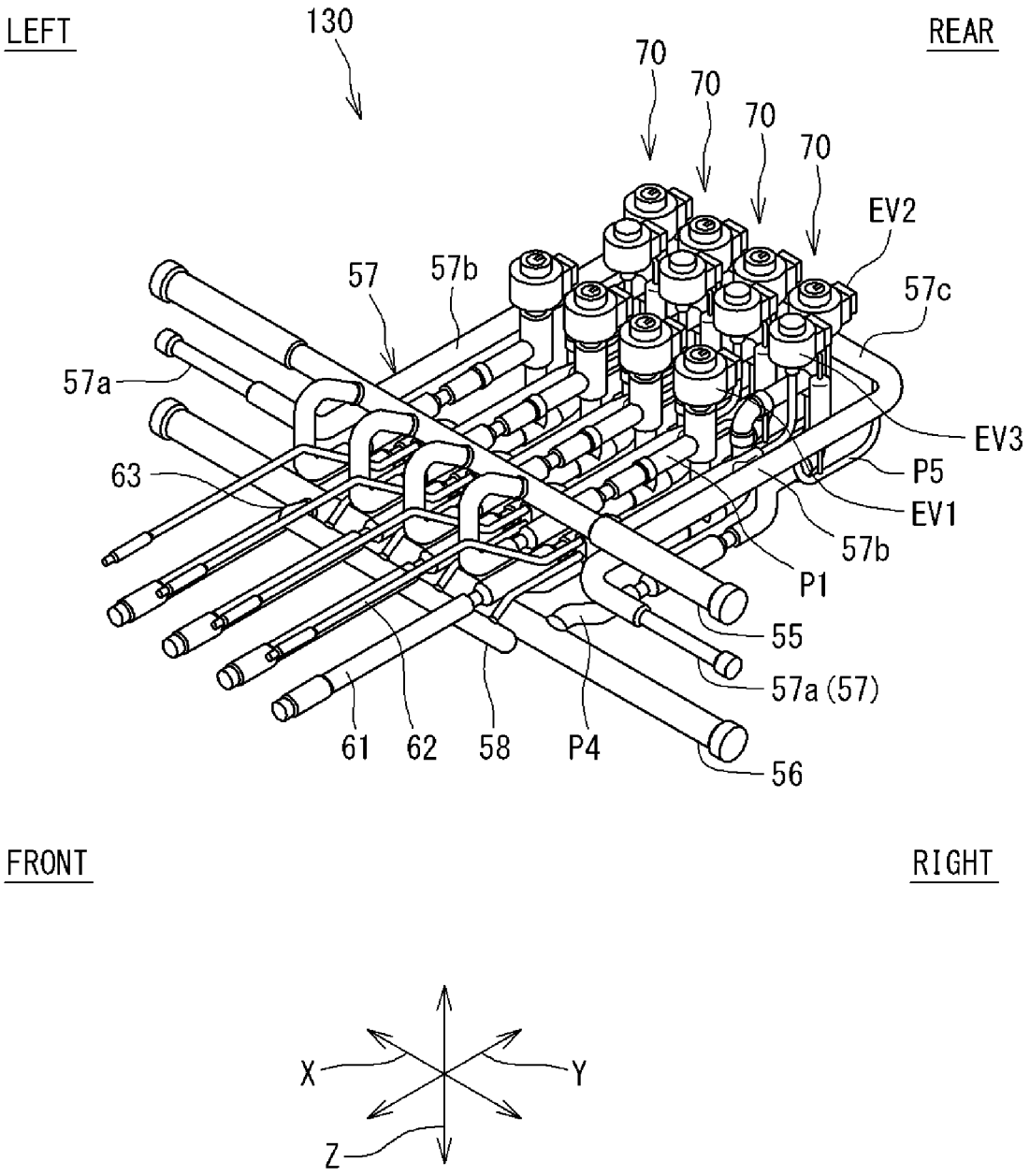
FIG. 6 is a perspective view depicting the internal configuration of the refrigerant flow path switching device.

FIG. 3 is a perspective view of the refrigerant flow path switching device. FIG. 4 is a plan view depicting an interior of the refrigerant flow path switching device. FIG. 5 is a side view depicting the interior of the refrigerant flow path switching device. FIG. 6 is a perspective view depicting the interior of the refrigerant flow path switching device.

As depicted in FIG. 3, the refrigerant flow path switching device 130 includes a casing 131. The casing 131 has a substantially rectangular parallelepiped shape. The casing 131 accommodates a plurality of header pipes 55, 56, 57, and 58 and a plurality of switching units 70.

The following description assumes that, in FIG. 3 to FIG. 6, a first direction Z corresponds to a vertical direction, a second direction Y corresponds to an anteroposterior direction, and a third direction X corresponds to a lateral direction. The first direction Z, the second direction Y, and the third direction X are perpendicular to one another.

The casing 131 has a rear wall 131*c* provided with a control box 132. The control box 132 accommodates the control unit of the refrigerant flow path switching device 130.

The control box 132 may be provided on a side wall 131*b* of the casing 131 as indicated by two-dot chain lines in FIG. 3. The side wall 131*b* is provided with an opening 131*e* closed by a detachable lid 131*f*, assuming provision of the control box 132. When the control box 132 is provided on the side wall 131*b* of the casing 131, the interior of the casing 131 and the interior of the control box 132 can communicate with each other by detaching the lid 131*f*.

(Header Pipes)

The plurality of header pipes 55, 56, 57, and 58 includes a first header pipe 55, a second header pipe 56, a third header pipe 57, and a fourth header pipe 58.

As depicted in FIG. 2, the first header pipe 55 is connected to the high and low-pressure gas connection pipe (first gas connection pipe) 13. The second header pipe 56 is connected to the sucked gas connection pipe (second gas connection pipe) 12. The third header pipe 57 is connected to the liquid connection pipe 11.

As depicted in FIG. 4 to FIG. 6, the first header pipe 55 has a linear shape in the lateral direction X. The second header pipe 56 also has a linear shape in the lateral direction X. The first header pipe 55 and the second header pipe 56 are aligned in the vertical direction Z. The first header pipe 55 is disposed above the second header pipe 56. The first header pipe 55 and the second header pipe 56 are disposed in parallel with each other.

As depicted in FIG. 3, both end parts of the first header pipe 55 and both end parts of the second header pipe 56 each project from left and right side walls 131*b* of the casing 131.

As depicted in FIG. 4 to FIG. 6, the third header pipe 57 has a pair of first portions 57*a*, a pair of second portions 57*b*, and a third portion 57*c*.

The pair of first portions 57*a* constitute both ends of the third header pipe 57. The first portions 57*a* are disposed in the lateral direction X. The first portions 57*a* are disposed substantially horizontally.

The third header pipe 57 is disposed vertically between the first header pipe 55 and the second header pipe 56. The first portions 57*a* of the third header pipe 57 are aligned with the first header pipe 55 and the second header pipe 56 in the vertical direction Z. The first portions 57*a* of the third header pipe 57 are disposed in parallel with the first header pipe 55 and the second header pipe 56. As depicted in FIG. 3, the first portions 57*a* of the third header pipe 57 project from the left and right side walls 131*b* of the casing 131.

As depicted in FIG. 5, in one or more embodiments, a center of the first header pipe 55, a center of the second header pipe 56, and centers of the first portions 57*a* of the third header pipe 57 are aligned linearly in the vertical direction Z. FIG. 5 depicts a straight line denoted by reference sign L1 and connecting the center of the first header pipe 55, the center of the second header pipe 56, and the centers of the first portions 57*a* of the third header pipe 57.

Figure 9:
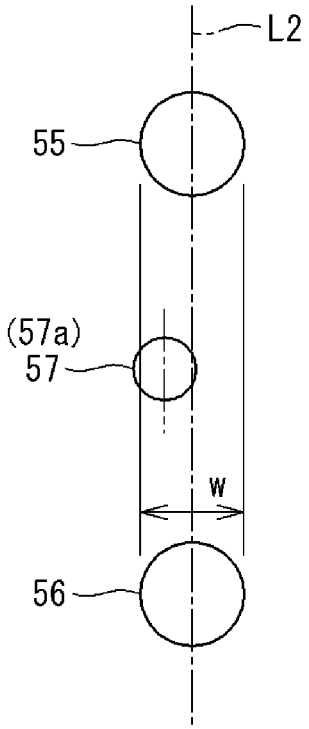
FIG. 9 is an explanatory side view of a first header pipe, a second header pipe, and a third header pipe being aligned, according to a modification example.

The center of the first header pipe 55, the center of the second header pipe 56, and the centers of the first portions 57*a* of the third header pipe 57 may not be necessarily disposed on the single straight line (the straight line L1). As depicted in FIG. 9, also in an exemplary case where the first portions 57*a* of the third header pipe 57 are overlapped with the first header pipe 55 and the second header pipe 56 along a straight line L2 connecting the centers of the first header pipe 55 and the second header pipe 56 (when the first portions 57*a* of the third header pipe 57 are disposed within a range denoted by w), the first portions 57*a* of the third header pipe 57 can be regarded as being aligned with the first header pipe 55 and the second header pipe 56 in the vertical direction Z.

As depicted in FIG. 4 and FIG. 6, the pair of second portions 57*b* of the third header pipe 57 are bent backward from inner end parts in the lateral direction X of the first portions 57*a* to extend. The second portions 57*b* are disposed in the anteroposterior direction Y. The second portions 57*b* are disposed substantially horizontally.

The third portion 57*c* of the third header pipe 57 connects rear end parts of the pair of second portions 57*b*. The third portion 57*c* is disposed in the lateral direction X. The third portion 57*c* is disposed substantially horizontally.

The first portions 57*a*, the second portions 57*b*, and the third portion 57*c* of the third header pipe 57 are disposed at same levels.

The pair of second portions 57*b* and the third portion 57*c* of the third header pipe 57 form a substantially U shape when viewed from above, to surround a plurality of valves EV1, EV2, and EV3 in the plurality of switching units 70.

The second portions 57*b* and the third portion 57*c* are disposed in the casing 131. The third portion 57*c* of the third header pipe 57 is connected with a first end of a fifth refrigerant tube P5 to be described later.

As depicted in FIG. 4 to FIG. 6, the fourth header pipe 58 is disposed in the lateral direction X. The fourth header pipe 58 is disposed ahead of the first header pipe 55, the second header pipe 56, and the third header pipe 57 in the anteroposterior direction Y. The fourth header pipe 58 is disposed at a position higher than the second header pipe 56 and lower than the third header pipe 57 in the vertical direction Z. The fourth header pipe 58 has a first end connected to the second header pipe 56 by a connecting pipe 63. This connecting pipe 63 and the fourth header pipe 58 constitute a second refrigerant tube P2 to be described later. As depicted in FIG. 5, the connecting pipe 63 constitutes a second slant portion extending forward and obliquely upward from the second header pipe 56.

(Switching Unit)

The refrigerant flow path switching device 130 includes the plurality of switching units 70. The switching units 70 each constitute the refrigerant circuit RC3 of the refrigerant flow path switching device 130.

As depicted in FIG. 4 and FIG. 6, the refrigerant flow path switching device 130 according to one or more embodiments includes four switching units 70. Each of the switching units 70 is connected with a single indoor unit 120. The refrigerant flow path switching device 130 according to one or more embodiments can thus be connected with four indoor units 120. All the switching units 70 of the refrigerant flow path switching device 130 are not necessarily connected with the indoor units 120, and the refrigerant flow path switching device 130 may include a switching unit 70 not connected to the indoor unit 120. When a plurality of refrigerant flow path switching devices 130 is connected to each other as to be described later with reference to FIG. 10, five or more indoor units 120 in total can be connected to the refrigerant flow path switching devices 130. The refrigerant flow path switching device 130 is not limited to include the four switching units 70, but may alternatively include two, three, or five or more switching units 70.

The plurality of switching units 70 is configured identically and is aligned in the lateral direction X. The refrigerant circuit RC3 in each of the switching units 70 includes the plurality of valves EV1, EV2, and EV3 and a plurality of refrigerant tubes.

Figure 7:
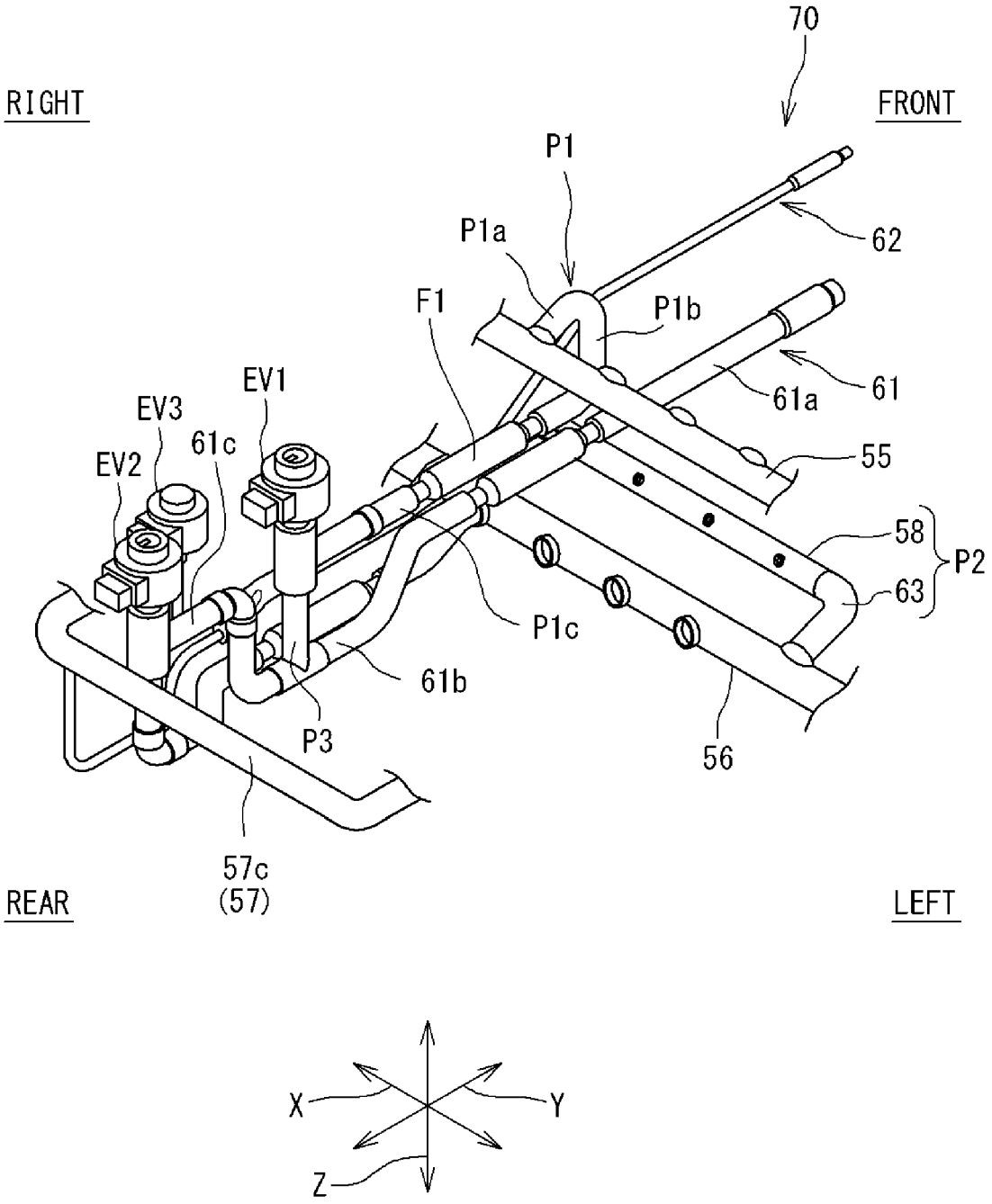
FIG. 7 is a perspective view, from a direction, of a single switching unit in the refrigerant flow path switching device.
Figure 8:
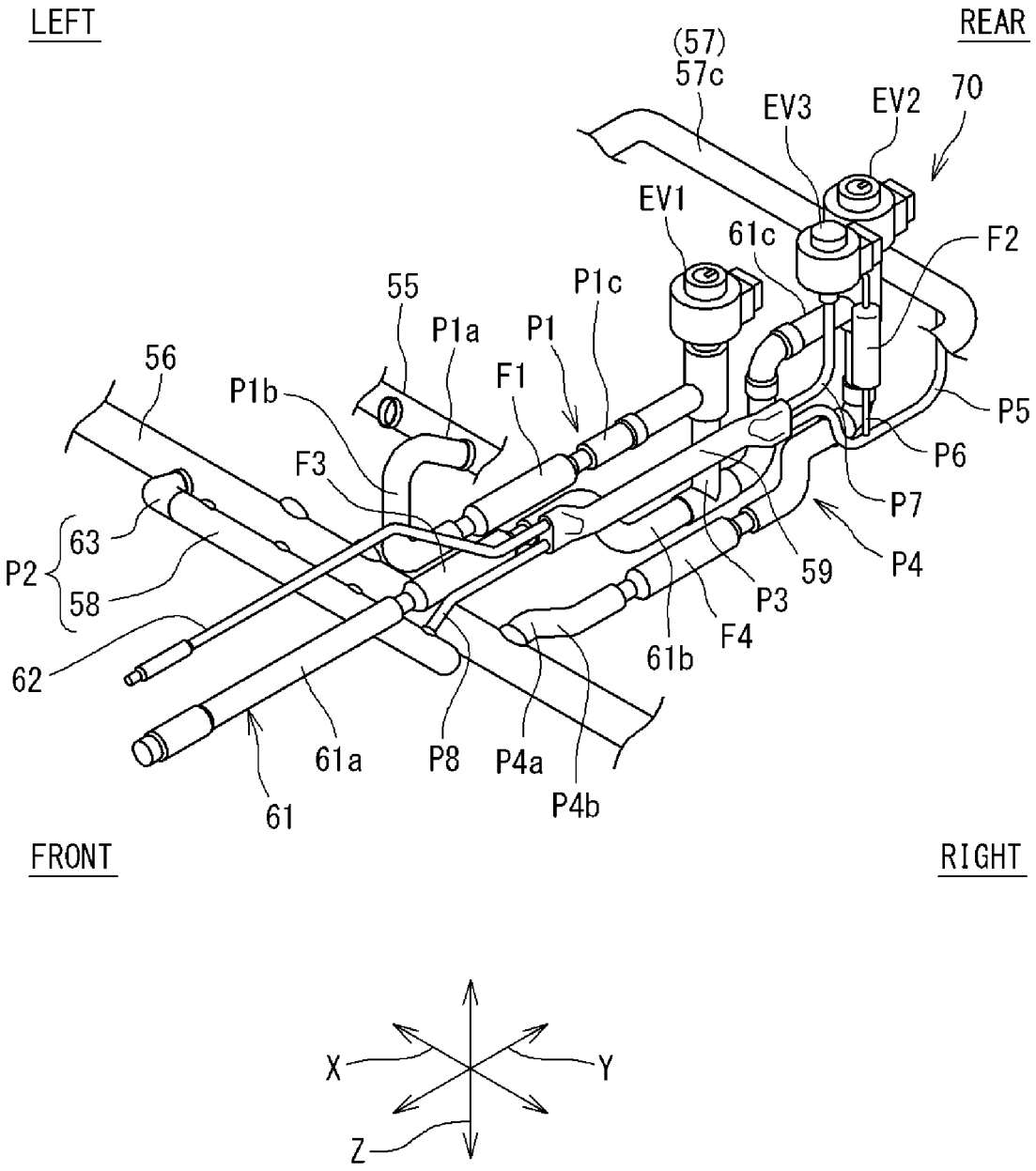
FIG. 8 is a perspective view, from another direction, of the single switching unit in the refrigerant flow path switching device.

FIG. 7 is a perspective view, from a direction, of a single switching unit in the refrigerant flow path switching device. FIG. 8 is a perspective view, from another direction, of the single switching unit in the refrigerant flow path switching device. FIG. 7 and FIG. 8 depict only part of the header pipes 55, 56, and 57.

The plurality of valves EV1, EV2, and EV3 in each of the switching units 70 includes a first valve EV1, a second valve EV2, and a third valve EV3. These valves EV1, EV2, and EV3 are each constituted by a motor operated valve having an adjustable opening degree. Each of the second valve EV2 and the third valve EV3 is operation controlled by a control unit to come into a fully closed state, a fully opened state, or an opening degree adjusted state. The first valve EV1 is operation controlled by a control unit to come into a minimum opening degree state, a fully opened state, or an opening degree adjusted state. The first valve EV1 is provided therein with a minute flow path (not depicted) allowing a refrigerant flow even in the minimum opening degree state, and is not fully closed.

The first valve EV1 and the second valve EV2 are aligned in the anteroposterior direction Y. Specifically, the first valve EV1 is disposed in front and the second valve EV2 is disposed behind. As depicted in FIG. 4, the third valve EV3 is disposed at a position anteroposteriorly between the first valve EV1 and the second valve EV2 and displaced in the lateral direction X.

As depicted in FIG. 5, the first valve EV1 and the second valve EV2 have upper ends disposed at substantially same levels in the vertical direction Z. The third valve EV3 is disposed at a position slightly lower than the first valve EV1 and the second valve EV2.

The first valve EV1, the second valve EV2, and the third valve EV3 are disposed behind and apart from the first header pipe 55, the second header pipe 56, and the third header pipe 57.

As depicted in FIG. 7 and FIG. 8, the switching unit 70 includes a first refrigerant tube P1 connecting the first header pipe 55 and the first valve EV1. The first refrigerant tube P1 includes a first portion P1*a* and second portions P1*b* and P1*c*.

As depicted also in FIG. 5, the first portion P1*a* extends forward and obliquely upward from the first header pipe 55. The first portion P1*a* constitutes a first slant portion. The first portion P1*a* has an upper end disposed at a position higher than the first header pipe 55. The upper end of the first portion P1*a* is disposed at an identical level to the upper ends of the first valve EV1 and the second valve EV2. The state of identical levels includes a case where the first portion P1*a* and the first and second valves EV1 and EV2 have a difference in level within 3.0 mm.

The second portions P1*b* and P1*c* of the first refrigerant tube P1 are bent from a front end of the first portion P1*a* to extend backward. The second portions P1*b* and P1*c* include a vertical portion P1*b* extending substantially vertically downward from the front end of the first portion P1*a*. The vertical portion P1*b* has a lower end disposed at a position lower than the first header pipe 55.

The second portions P1*b* and P1*c* include a horizontal portion P1*c* extending horizontally backward from the lower end of the vertical portion P1*b*. The horizontal portion P1*c* has a rear end connected to a first end of the first valve EV1.

The horizontal portion P1*c* of the first refrigerant tube P1 passes below the first header pipe 55 in the anteroposterior direction Y. The horizontal portion P1*c* and the third header pipe 57 are disposed at substantially same levels. As depicted in FIG. 4, the horizontal portion P1*c* of the first refrigerant tube P1 and the second portions 57*b* of the third header pipe 57 are aligned in parallel with each other in the lateral direction X. The horizontal portion P1*c* has a halfway portion provided with a filter F1.

As depicted in FIG. 5, the casing 131 is provided therein with a space S defined in the anteroposterior direction Y by the first header pipe 55 and the first valve EV1 and defined in the vertical direction Z by the first refrigerant tube P1 (see FIG. 6) and an upper wall 131*d*. As depicted in FIG. 3, this space S is accessible from the outside when the lid 131*f* is detached from the side wall 131*b* of the casing 131 to open the opening 131*e*. This space S is utilized to facilitate maintenance and the like of the plurality of valves EV1, EV2, and EV3.

As depicted in FIG. 7, the switching unit 70 includes a third refrigerant tube P3 connected to a second end of the first valve EV1. The third refrigerant tube P3 extends downward from the first valve EV1.

The switching unit 70 includes a utilization gas pipe 61 connected to the gas tube GP of the indoor unit 120. The third refrigerant tube P3 has a lower end part connected to a halfway portion in a longitudinal direction of the utilization gas pipe 61.

The utilization gas pipe 61 extends in the anteroposterior direction Y. The utilization gas pipe 61 has a first portion 61*a* disposed substantially horizontally. As depicted in FIG. 5, the first portion 61*a* of the utilization gas pipe 61 passes between the first header pipe 55 and the second header pipe 56 in the vertical direction Z, and extends forward beyond the first header pipe 55 and the second header pipe 56. The first portion 61*a* of the utilization gas pipe 61 is disposed at a position lower than the third header pipe 57 and higher than the fourth header pipe 58. The first portion 61*a* is provided with a filter F3. As depicted in FIG. 3, the first portion 61*a* of the utilization gas pipe 61 projects forward from a front wall 131*a* of the casing 131.

As depicted in FIG. 7, the utilization gas pipe 61 has a third portion 61*c* connected to a first end of the second valve EV2. The third portion 61*c* is disposed substantially horizontally at a position higher than the first portion 61*a*, and behind the first valve EV1.

The utilization gas pipe 61 has a second portion 61*b* between the first portion 61*a* and the third portion 61*c*. The second portion 61*b* is bent downward from the first portion 61*a* and the third portion 61*c* to have a substantially U shape. The second portion 61*b* is connected to a lower end of the third refrigerant tube P3.

As depicted in FIG. 5 and FIG. 8, the second valve EV2 has a second end connected with a rear end of a fourth refrigerant tube P4. The fourth refrigerant tube P4 has a front end connected to the second header pipe 56. The fourth refrigerant tube P4 has a halfway portion provided with a filter F4.

As depicted in FIG. 5, the front end of the fourth refrigerant tube P4 has a first portion P4*a* extending backward an obliquely upward from the second header pipe 56. The fourth refrigerant tube P4 has a second portion P4*b* extending backward and obliquely downward from the first portion P4*a*.

The switching unit 70 includes a utilization liquid pipe 62 connected to the liquid tube LP of the indoor unit 120. The utilization liquid pipe 62 extends in the anteroposterior direction Y. As depicted in FIG. 4, the utilization liquid pipe 62 is disposed in parallel with the utilization gas pipe 61 when viewed from above. As depicted in FIG. 3, the utilization liquid pipe 62 projects forward from the front wall 131*a* of the casing 131.

As depicted in FIG. 5 and FIG. 8, the utilization liquid pipe 62 has a rear end connected to a subcooling heat exchanger 59. The subcooling heat exchanger 59 is disposed in the anteroposterior direction Y. As depicted in FIG. 2, the subcooling heat exchanger 59 is provided therein with a first heat transfer tube 59*a* and a second heat transfer tube 59*b*. The subcooling heat exchanger 59 causes heat exchange between the refrigerant flowing in the first heat transfer tube 59*a* and the refrigerant flowing in the second heat transfer tube 59*b*.

As depicted in FIG. 2 and FIG. 5, the rear end of the utilization liquid pipe 62 is connected to a first end (front end) of the first heat transfer tube 59*a*. The first heat transfer tube 59*a* has a second end (rear end) connected with the first end (front end) of the fifth refrigerant tube P5. The fifth refrigerant tube P5 has a second end (rear end) connected to the third portion 57*c* of the third header pipe 57.

As depicted in FIG. 5 and FIG. 8, the switching unit 70 includes a sixth refrigerant tube P6 branching from a halfway portion of the fifth refrigerant tube P5. The sixth refrigerant tube P6 extends upward from the fifth refrigerant tube P5. The sixth refrigerant tube P6 has an upper end part connected to a first end of the third valve EV3. The sixth refrigerant tube P6 has a halfway portion provided with a filter F2.

The third valve EV3 has a second end connected with an upper end of a seventh refrigerant tube P7. The seventh refrigerant tube P7 has a lower end part connected to a first end (rear end) of the second heat transfer tube 59*b* of the subcooling heat exchanger 59 depicted in FIG. 2. The second heat transfer tube 59*b* of the subcooling heat exchanger 59 has a second end (front end) connected with a first end (rear end) of an eighth refrigerant tube P8. The eighth refrigerant tube P8 has a second end (front end) connected to the second refrigerant tube P2.

The second refrigerant tube P2 according to one or more embodiments includes the fourth header pipe 58 described earlier, and the connecting pipe 63 connecting the fourth header pipe 58 to the second header pipe 56. As depicted in FIG. 5, the connecting pipe 63 extends forward and obliquely upward from the second header pipe 56. The connecting pipe 63 constitutes the second slant portion. The connecting pipe 63 has an upper end connected to the fourth header pipe 58.

The eighth refrigerant tube P8 extends forward and substantially horizontally from the subcooling heat exchanger 59. The eighth refrigerant tube P8 has a front end part P8*a* extending forward and obliquely downward and connected to the fourth header pipe 58.

As to be described later, the fourth header pipe 58 receives the refrigerant flowing from the third header pipe 57 via the fifth refrigerant tube P5, the sixth refrigerant tube P6, the third valve EV3, the seventh refrigerant tube P7, the subcooling heat exchanger 59, and the eighth refrigerant tube P8. The refrigerant having flowed into the fourth header pipe 58 passes through the connecting pipe 63 and flows into the second header pipe 56.

[Operation of Air Conditioning System]

Description is made hereinafter with reference to FIG. 2 to a case where all the indoor units 120 in operation in the air conditioning system 100 execute cooling operation (hereinafter, also referred to as "full cooling operation"), a case where all the indoor units 120 in operation execute heating operation (hereinafter, also referred to as "full heating operation), and a case where some of the indoor units 120 in operation execute cooling operation and the remaining ones execute heating operation (hereinafter, also referred to as "cooling and heating mixed operation").

(Full Cooling Operation)

During full cooling operation, the first valve EV1 in the switching unit 70 is fully opened. The second valve EV2 is fully opened. The third valve EV3 is adjusted in opening degree. The indoor expansion valve 51 is adjusted in opening degree. The first and second outdoor expansion valves 34 and 35 are fully opened.

In the indoor unit 120 being stopped, during any one of full cooling operation, full heating operation, and cooling and heating mixed operation, the indoor expansion valve 51 is fully closed, the first valve EV1 corresponding to this indoor unit 120 has the minimum opening degree, and the second valve EV2 and the third valve EV3 are fully closed.

When the compressor 25 is driven, a high-pressure gas refrigerant compressed by the compressor 25 passes through the discharge pipe 25*a*, the first flow path switching valve 26, the third flow path switching valve 28, and the like, and flows into the outdoor heat exchanger 30 to be condensed. The refrigerant condensed in the outdoor heat exchanger 30 passes through the first and second outdoor expansion valves 34 and 35, the liquid-side shutoff valve 23, and the like, and flows into the liquid connection pipe 11.

The refrigerant having flowed into the liquid connection pipe 11 flows in the third header pipe 57 of the refrigerant flow path switching device 130, and flows into the fifth refrigerant tube P5 of each of the switching units 70. The refrigerant having flowed into the fifth refrigerant tube P5 flows into the first heat transfer tube 59*a* of the subcooling heat exchanger 59, and then passes through the utilization liquid pipe 62 to flow into the indoor unit 120.

The refrigerant having flowed into the fifth refrigerant tube P5 also branches to the sixth refrigerant tube P6, is decompressed in accordance with the opening degree of the third valve EV3, and flows into the second heat transfer tube 59*b* of the subcooling heat exchanger 59. The refrigerant flowing in the first heat transfer tube 59*a* and the refrigerant flowing in the second heat transfer tube 59*b* exchange heat with each other in the subcooling heat exchanger 59, and the refrigerant flowing in the first heat transfer tube 59*a* is subcooled and flows into the indoor unit 120.

The refrigerant flowing in the second heat transfer tube 59*b* of the subcooling heat exchanger 59 flows from the eighth refrigerant tube P8 into the fourth header pipe 58, passes through the connecting pipe 63, and flows into the second header pipe 56.

The refrigerant having flowed into the indoor unit 120 is decompressed at the indoor expansion valve 51 and is then evaporated in the indoor heat exchanger 52.

In the indoor unit 120, the refrigerant evaporated in the indoor heat exchanger 52 flows from the gas tube GP into the utilization gas pipe 61, mainly passes through the second valve EV2, and flows into the second header pipe 56.

The refrigerant having flowed into the second header pipe 56 passes through the sucked gas connection pipe 12, flows into the outdoor unit 110, and is sucked into the compressor 25.

The refrigerant having flowed into the utilization gas pipe 61 also passes through the first valve EV1 and flows into the first header pipe 55. The refrigerant (low-pressure gas refrigerant) having flowed into the first header pipe 55 passes through the high and low-pressure gas connection pipe 13, the second flow path switching valve 27, and the accumulator 24, and is sucked into the compressor 25.

(Regarding Full Heating Operation)

During full heating operation, the first valve EV1 in the switching unit 70 is fully opened. The second valve EV2 is fully closed. The third valve EV3 is fully closed. The indoor expansion valve 51 is fully opened. The first and second outdoor expansion valves 34 and 35 are adjusted in opening degree.

When the compressor 25 is driven, the high-pressure gas refrigerant compressed by the compressor 25 passes through the discharge pipe 25*a*, the second flow path switching valve 27, and the like, and flows into the high and low-pressure gas connection pipe 13. The refrigerant having flowed into the high and low-pressure gas connection pipe 13 passes through the first header pipe 55 of the refrigerant flow path switching device 130, the first refrigerant tube P1 of the switching unit 70, and then the first valve EV1, and flows from the utilization gas pipe 61 into the gas tube GP of the indoor unit 120.

The refrigerant having flowed into the gas tube GP flows into the indoor heat exchanger 52 of the indoor unit 120 to be condensed. The condensed refrigerant passes through the indoor expansion valve 51, flows in the liquid tube LP, and flows into the utilization liquid pipe 62 of the switching unit 70. The refrigerant having flowed into the utilization liquid pipe 62 passes through the subcooling heat exchanger 59 and the fifth refrigerant tube P5, and flows into the third header pipe 57.

The refrigerant having flowed into the third header pipe 57 flows in the liquid connection pipe 11, flows into the outdoor unit 110, and is decompressed at the first and second outdoor expansion valves 34 and 35. The decompressed refrigerant is evaporated while passing through the outdoor heat exchanger 30, passes through the first flow path switching valve 26, the third flow path switching valve 28, and the like, and is sucked into the compressor 25.

(Regarding Cooling and Heating Mixed Operation)

In the switching unit 70 (hereinafter, also referred to as a "cooling switching unit 70") corresponding to the indoor unit 120 (hereinafter, also referred to as a "cooling indoor unit 120") executing cooling operation among the indoor units 120 in operation, the first valve EV1 has the minimum opening degree. The second valve EV2 is fully opened. The third valve EV3 is adjusted in opening degree. The indoor expansion valve 51 of the cooling indoor unit 120 is adjusted in opening degree.

In the switching unit 70 (hereinafter, also referred to as a "heating switching unit 70") corresponding to the indoor unit 120 (hereinafter, also referred to as a "heating indoor unit 120") executing heating operation among the indoor units 120 in operation, the first valve EV1 is fully opened. The second valve EV2 is fully closed. The third valve EV3 is fully closed. The indoor expansion valve 51 of the heating indoor unit 120 is fully opened. The first outdoor expansion valve 34 and the second outdoor expansion valve 35 are adjusted in opening degree.

When the compressor 25 is driven, part of the high-pressure gas refrigerant compressed by the compressor 25 passes through the discharge pipe 25*a*, the second flow path switching valve 27, and the like, and flows into the high and low-pressure gas connection pipe 13. The remaining part of the high-pressure gas refrigerant compressed by the compressor 25 passes through the discharge pipe 25*a* and the third flow path switching valve 28, is condensed at the first heat exchange unit 31 of the outdoor heat exchanger 30, passes through the first outdoor expansion valve 34, and flows into the liquid connection pipe 11. The refrigerant having been condensed at the first heat exchange unit 31 passes through the second outdoor expansion valve 35, is evaporated at the second heat exchange unit 32, passes through the first flow path switching valve 26, and is sucked into the compressor 25.

The refrigerant having flowed into the high and low-pressure gas connection pipe 13 flows into the first header pipe 55 of the refrigerant flow path switching device 130, flows in the first refrigerant tube P1 of the heating switching unit 70, the first valve EV1, and the utilization gas pipe 61, and flows into the gas tube GP.

The refrigerant having flowed into the gas tube GP is condensed in the indoor heat exchanger 52 of the heating indoor unit 120. The condensed refrigerant flows from the liquid tube LP into the utilization liquid pipe 62 of the heating switching unit 70, flows in the subcooling heat exchanger 59 and the fifth refrigerant tube P5, and flows into the third header pipe 57.

The refrigerant having flowed from the outdoor unit 110 into the liquid connection pipe 11 also flows into the third header pipe 57. The refrigerant having flowed into the third header pipe 57 passes through the fifth refrigerant tube P5 of the cooling switching unit 70, the subcooling heat exchanger 59, the utilization liquid pipe 62, and the liquid tube LP, and flows into the cooling indoor unit 120. The refrigerant having passed through the subcooling heat exchanger 59 is subcooled by the refrigerant having branched from the fifth refrigerant tube P5, having flowed in the sixth refrigerant tube P6, and having been decompressed at the third valve EV3.

The refrigerant having flowed into the cooling indoor unit 120 is decompressed at the indoor expansion valve 51, and is evaporated in the indoor heat exchanger 52 to cool the indoor space.

The evaporated refrigerant flows in the gas tube GP, flows into the utilization gas pipe 61 of the heating switching unit 70, passes through the second valve EV2, flows into the fourth refrigerant tube P4 and the second header pipe 56, and flows in the sucked gas connection pipe 12 to be sucked into the compressor 25.

(Exemplary Connection of Refrigerant Flow Path Switching Device)

Figure 10:
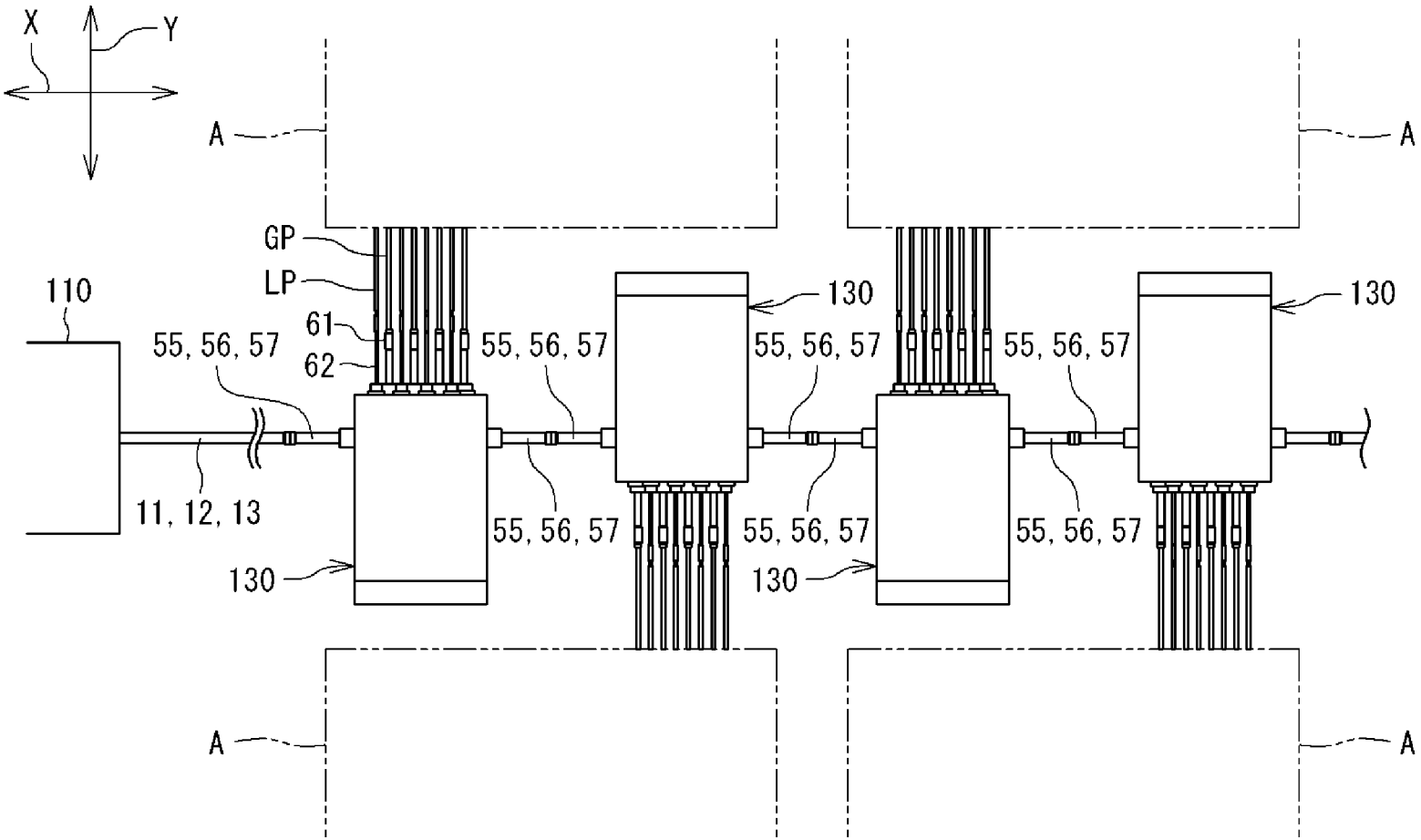
FIG. 10 is an explanatory plan view depicting exemplary connection between an outdoor unit and a plurality of refrigerant flow path switching devices.

FIG. 10 is an explanatory plan view depicting exemplary connection between the outdoor unit and a plurality of refrigerant flow path switching devices. FIG. 10 exemplifies a case where the plurality of refrigerant flow path switching devices 130 is aligned in the third direction X with orientations in the second direction Y being alternately changed. The first header pipes 55, the second header pipes 56, and the third header pipes 57 of the adjacent refrigerant flow path switching devices 130 are connected to each other. In the refrigerant flow path switching device 130 disposed at a first end part of the plurality of refrigerant flow path switching devices 130 being aligned, first ends of the first header pipe 55, the second header pipe 56, and the third header pipe 57 are connected directly to the high and low-pressure gas connection pipe 13, the sucked gas connection pipe 12, and the liquid connection pipe 11 extending from the outdoor unit 110. The plurality of refrigerant flow path switching devices 130 is thus connected in series to the outdoor unit 110.

The plurality of refrigerant flow path switching devices 130 includes ones each having the utilization gas pipe 61 and the utilization liquid pipe 62 projecting to a first side in the second direction Y and ones each having the utilization gas pipe 61 and the utilization liquid pipe 62 projecting to a second side in the second direction Y, which are disposed alternately. This disposition facilitates installation of the refrigerant pipes toward an air conditioning zone A disposed on the first side in the second direction Y and an air conditioning zone A disposed on the second side with respect to the plurality of refrigerant flow path switching devices 130, so that the refrigerant pipes (the gas tubes GP and the liquid tubes LP) can be connected to the indoor units 120 installed in the air conditioning zones A. The both end parts of the first header pipe 55, the both end parts of the second header pipe 56, and the both end parts 57*a* of the third header pipe 57 are aligned in the vertical direction Z in one or more embodiments. Even in the case where the plurality of refrigerant flow path switching devices 130 is aligned such that the utilization gas pipes 61 and the utilization liquid pipes 62 of the refrigerant flow path switching devices 130 project alternately to the first side and the second side in the second direction Y as described above, the first header pipes 55, the second header pipes 56, and the third header pipes 57 of the adjacent refrigerant flow path switching devices 130 can be connected to each other.

The refrigerant flowing out of the outdoor unit 110 passes through the plurality of refrigerant flow path switching devices 130, and flows from the refrigerant flow path switching devices 130 into the indoor units 120. The refrigerant flowing out of each of the indoor units 120 flows from the corresponding refrigerant flow path switching device 130 and flows into the outdoor unit 110 via a remaining one of the refrigerant flow path switching devices 130 or directly. Even in a case where the indoor unit 120 being stopped is connected to any one of the refrigerant flow path switching devices 130, the refrigerant flows to the header pipes 55, 56, and 57 of the refrigerant flow path switching device 130.

Operation and Effects of One or More Embodiments

The refrigerant flow path switching device described in PATENT LITERATURE 1 is disposed in a ceiling space of a room in a hotel, a building, or the like provided with an air conditioning system.

In the refrigerant flow path switching device described in PATENT LITERATURE 1, the plurality of valves is aligned anteroposteriorly and the second header pipe and the third header pipe are disposed below the plurality of valves. This configuration leads to a large vertical length of the refrigerant flow path switching device. One or more embodiments of the present disclosure provide a refrigerant flow path switching device that can be reduced in size.

Operation and Effects

The refrigerant flow path switching device 130 according to the above embodiments will be described hereinafter in terms of operation and effects.

(1) The refrigerant flow path switching device 130 according to one or more embodiments includes the first header pipe 55 connectable to the high and low-pressure gas connection pipe (first gas connection pipe) 13 of the outdoor unit 110 in the air conditioner 101, the second header pipe 56 connectable to the sucked gas connection pipe (second gas connection pipe) 12 of the outdoor unit 110, and the third header pipe 57 connectable to the liquid connection pipe 11 of the outdoor unit 110. The refrigerant flow path switching device 130 further includes the switching unit 70 having the plurality of valves EV1, EV2, and EV3 each configured to control the refrigerant flow, and provided correspondingly to each of the plurality of indoor units 120 in the air conditioner 101. The refrigerant flow path switching device 130 further includes the casing 131 accommodating the first header pipe 55, the second header pipe 56, the third header pipe 57, and the switching unit 70. The refrigerant flow path switching device 130 switches among refrigerant flow paths between the outdoor unit 110 and the plurality of indoor units 120.

As depicted in FIG. 3, in one or more embodiments, the ends of the first header pipe 55, the ends of the second header pipe 56, and the ends of the third header pipe 57 project outward from the casing 131 and are aligned linearly in the vertical direction (first direction) Z. The plurality of valves EV1, EV2, and EV3 in the switching unit 70 are disposed apart from the ends of the first header pipe 55 in the anteroposterior direction (second direction) Y perpendicular to the vertical direction Z and the lateral direction (third direction) X in which the ends extend.

The refrigerant flow path switching device 130 configured as described above achieves reduction in length of the casing 131 in the vertical direction Z and thus reduction in size of the casing 131. The refrigerant flow path switching device 130 can thus be easily installed in a small space such as a ceiling space. Particularly in recent years, the ceiling space tends to be reduced in length in the vertical direction Z in order to secure a larger residential space in a room. The refrigerant flow path switching device 130 according to one or more embodiments can be easily installed in a space having a small length in the vertical direction Z.

(2) According to the above embodiments, the switching unit 70 includes the utilization gas pipe 61 and the utilization liquid pipe 62 connectable to the indoor unit 120. The utilization gas pipe 61 and the utilization liquid pipe 62 extend in the anteroposterior direction Y beyond the first header pipe 55, the second header pipe 56, and the third header pipe 57 oppositely (forward) from the plurality of valves EV1, EV2, and EV3. Such a configuration enables close disposition of the end parts of the first to third header pipes 55, 56, and 57 to the utilization gas pipe 61 and the utilization liquid pipe 62. This disposition facilitates work applied to these pipes, such as connection to a different pipe, inspection, and the like, via an inspection hole or the like provided at a ceiling.

(3) The switching unit 70 according to the above embodiments includes the first refrigerant tube P1 connecting the first header pipe 55 and the first valve EV1 included in the plurality of valves EV1, EV2, and EV3. The first refrigerant tube P1 is provided with the filter F1 configured to remove foreign matter contained in the refrigerant. The filter F1 provided at each of the first refrigerant tubes P1 can thus be reduced in size in comparison to a case where the filter is provided at the first header pipe 55 connected with the first refrigerant tubes P1 of the plurality of switching units 70.

(4) As depicted in FIG. 5, the first refrigerant tube P1 according to the above embodiments includes the first portion P1*a* extending from the first header pipe 55 oppositely (forward) from the first valve EV1 in the anteroposterior direction Y, and the second portions P1*b* and P1*c* redirected toward the first valve EV1 (backward) from the first portion P1*a* and connected to the first valve EV1. The first header pipe 55 is disposed above (a first side in the vertical direction Z) the second header pipe 56 and the third header pipe 57, and the first portion P1*a* of the first refrigerant tube P1 extends obliquely upward from the first header pipe 55. An upper end part of the first portion P1*a* (a first end in the vertical direction Z) and upper end parts of the first and second valves EV1 and EV2 disposed on an uppermost side among the plurality of valves EV1, EV2, and EV3 are disposed at same positions in the vertical direction Z.

Such a configuration enables disposition of the upper wall 131*d* of the casing 131 accommodating the switching unit 70 and the header pipes 55, 56, and 57 close to both the upper end of the first portion P1*a* of the first refrigerant tube P1 and the upper ends of the valves EV1 and EV2, which achieves effective utilization of the space in the casing 131.

The "same positions" in the vertical direction Z indicates identical positions as well as substantially same positions (e.g. dimensional difference within 3.0 mm).

(5) According to the above embodiments, the both end parts 57*a* of the third header pipe 57 are aligned with the both end parts of the first header pipe 55 and the both end parts of the second header pipe 56 in the vertical direction Z. The third header pipe 57 has the second and third portions 57*b* and 57*c* disposed between the both end parts 57*a* and surrounding the plurality of valves EV1, EV2, and EV3 in the plurality of switching units 70 when viewed from above. The both end parts 57*a* of the third header pipe 57 and the both end parts of the first and second header pipes 55 and 56 can thus be aligned linearly while avoiding interference with the plurality of valves EV1, EV2, and EV3.

(6) According to the above embodiments, the casing 131 is provided therein with the space S having the both ends in the anteroposterior direction Y defined by an end header pipe (first header pipe) 55 disposed at the upper end part among the first header pipe 55, the second header pipe 56, and the third header pipe 57 and an adjacent valve (first valve) EV1 most adjacent to the end header pipe 55 in the anteroposterior direction Y among the plurality of valves EV1, EV2, and EV3 in the switching unit 70, and having the both ends in the vertical direction Z defined by the first refrigerant tube P1 connecting the end header pipe 55 and the adjacent valve EV1 and the upper wall 131*d* of the casing 131. This space S is utilized to facilitate inspection, maintenance, and the like of the valves EV1, EV2, and EV3 in the switching unit 70.

(7) The refrigerant flow path switching device 130 according to one or more embodiments includes the first header pipe 55 connectable to the high and low-pressure gas connection pipe (first connection pipe) 13 of the outdoor unit 110 in the air conditioner 101, and the third header pipe 57 connectable to the liquid connection pipe 11 of the outdoor unit 110. The refrigerant flow path switching device 130 further includes the switching unit 70 having the plurality of valves EV1, EV2, and EV3 each configured to control the refrigerant flow, and provided correspondingly to each of the plurality of indoor units 120 in the air conditioner 101. The refrigerant flow path switching device 130 further includes the casing 131 accommodating the first header pipe 55, the third header pipe 57, and the switching unit 70. The refrigerant flow path switching device 130 switches among refrigerant flow paths between the outdoor unit 110 and the plurality of indoor units 120.

As depicted in FIG. 5, the switching unit 70 according to the above embodiments includes the first refrigerant tube P1 connected to the first header pipe 55, and the first refrigerant tube P1 has the first portion (first slant portion) P1*a* extending obliquely upward from the first header pipe 55.

The refrigerant flow path switching device 130 configured as described above inhibits the refrigerating machine oil contained in the refrigerant flowing in the first header pipe 55 from flowing into the switching unit 70 from the first refrigerant tube P1 of the switching unit 70 corresponding to the indoor unit 120 being stopped or accumulating in the switching unit 70.

(8) As depicted in FIG. 5, the above embodiments provide the second header pipe 56 connected to the sucked gas connection pipe (second gas connection pipe) 12 of the outdoor unit 110, the switching unit 70 includes the second refrigerant tube P2 connected to the second header pipe 56, and the second refrigerant tube P2 has the connecting pipe (second slant portion) 63 extending obliquely upward from the second header pipe 56. This configuration inhibits the refrigerating machine oil contained in the refrigerant flowing in the second header pipe 56 from flowing into the second refrigerant tube P2 of the switching unit 70 corresponding to the indoor unit 120 being stopped or accumulating in the switching unit 70.

(9) As depicted in FIG. 5, according to the above embodiments, the first portion (first slant portion) P1*a* of the first refrigerant tube P1 and the connecting pipe (second slant portion) 63 of the second refrigerant tube P2 extend respectively from the first header pipe 55 and the second header pipe 56 toward the front side wall 131*a* of the casing 131. Both the first portion P1*a* of the first refrigerant tube P1 and the connecting pipe 63 of the second refrigerant tube P2 for inhibition of accumulation of the refrigerating machine oil in the switching unit 70 can thus be disposed in the space among the front side wall 131*a* of the casing 131, the first header pipe 55, and the second header pipe 56.

(10) As depicted in FIG. 5, the second refrigerant tube P2 according to the above embodiments includes the fourth header pipe 58 configured to receive the refrigerant from the third header pipe 57 and connected with the upper end of the connecting pipe 63. The refrigerant having flowed from the third header pipe 57 into the fourth header pipe 58 flows in the connecting pipe 63 disposed to slant downward toward the second header pipe 56 to flow into the second header pipe 56. The refrigerant thus flows smoothly from the fourth header pipe 58 to the second header pipe 56 to inhibit the refrigerating machine oil in the refrigerant from accumulating in the fourth header pipe 58 and the connecting pipe 63.

(11) As depicted in FIG. 5, the eighth refrigerant tube P8 according to the above embodiments has the front end part (third slant portion) P8*a* extending obliquely downward toward the fourth header pipe 58. The refrigerant thus flows smoothly also from the eighth refrigerant tube P8 to the fourth header pipe 58 to inhibit the refrigerating machine oil in the refrigerant from accumulating in the eighth refrigerant tube P8.

(12) As depicted in FIG. 4 and FIG. 5, according to the above embodiments, the both end parts (first portions) 57*a* of the third header pipe 57 are aligned with the both end parts of the first header pipe 55 in the vertical direction Z, the plurality of valves EV1, EV2, and EV3 in the switching unit 70 are disposed apart from the both end parts 57*a* of the third header pipe 57 in the anteroposterior direction Y perpendicular to the lateral direction X in which the both end parts 57*a* of the third header pipe 57 extend, and the third header pipe 57 has the second and third portions 57*b* and 57*c* disposed between the both end parts 57*a* and surrounding the plurality of valves EV1, EV2, and EV3 in the plurality of switching units 70 when viewed from above. The first header pipe 55, the both end parts 57*a* of the third header pipe 57, and the plurality of valves EV1, EV2, and EV3 can thus be disposed so as not to be overlapped in the vertical direction Z, achieving reduction in length of the casing 131 in the vertical direction Z and thus reduction in size of the casing. The third header pipe 57 has the second and third portions 57*b* and 57*c* disposed between the both end parts 57*a* and surrounding the plurality of valves EV1, EV2, and EV3. The both end parts 57*a* of the third header pipe 57 and the both end parts of the first header pipe 55 can thus be aligned in the vertical direction Z while avoiding interference with the plurality of valves EV1, EV2, and EV3.

(13) According to the above embodiments, the casing 131 has the pair of side walls 131*b* facing each other, and the both end parts of the first header pipe 55 project outward from the casing 131 via the pair of side walls 131*b*. As depicted in FIG. 10, the first header pipes 55 of the plurality of refrigerant flow path switching devices 130 can thus be connected in series. In this case, the refrigerant flows to the first header pipe 55 even in a state where the indoor units 120 corresponding to all the switching units 70 in any one of the refrigerant flow path switching devices 130. The refrigerating machine oil contained in the refrigerant more possibly accumulates in the switching units 70. Accordingly, more effectively provided are the first refrigerant tube P1 having the first portion (first slant portion) P1*a* extending obliquely upward from the first header pipe 55 and the second refrigerant tube P2 having the connecting pipe (second slant portion) 63 extending obliquely upward from the second header pipe 56 as described above.

(14) As depicted in FIG. 5, the front end part (fourth slant portion) P4*a* of the fourth refrigerant tube P4 according to the above embodiments extends obliquely upward from the second header pipe 56. This configuration inhibits the refrigerating machine oil contained in the refrigerant flowing in the second header pipe 56 from flowing into the fourth refrigerant tube P4 of the switching unit 70 corresponding to the indoor unit 120 being stopped or accumulating in the switching unit 70.

Other Modification Examples

The present disclosure should not be limited to the embodiments described above, and can be variously modified within the scope of the claims.

For example, the refrigerant flow path switching device 130 may be installed at a location other than an indoor ceiling space.

The above embodiments refer to the cases where the refrigerant flow path switching device 130 is disposed assuming that the first direction Z corresponds to the vertical direction, the second direction Y corresponds to the anteroposterior direction, and the third direction X corresponds to the lateral direction. The present disclosure should not be limited to these cases, and the refrigerant flow path switching device 130 may alternatively be disposed exemplarily assuming that the first direction Z corresponds to a horizontal direction (the lateral direction or the anteroposterior direction).

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

11 liquid connection pipe
12 sucked gas connection pipe

13 high and low-pressure gas connection pipe
55 first header pipe
56 second header pipe
57 third header pipe
57*a* first portion (both end parts)
57*b* second portion
57*c* third portion
58 fourth header pipe
61 utilization gas pipe
62 utilization liquid pipe
70 switching unit
100 air conditioning system
101 air conditioner
110 outdoor unit (heat source unit)
120 indoor unit (utilization unit)
130 refrigerant flow path switching device
131 casing
EV1 first valve
EV2 second valve
EV3 third valve
F1 filter
P1 first refrigerant tube
P1*a* first portion (first slant portion)
P2 second refrigerant tube
S space
X lateral direction (third direction)
Y anteroposterior direction (second direction)
Z vertical direction (first direction)

What is claimed is:

1. A refrigerant flow path switching device comprising:
a first header pipe that is connected to a high-and-low-pressure gas connection pipe of an outdoor unit in an air conditioner;
a second header pipe that is connected to a sucked-gas connection pipe of the outdoor unit;
a third header pipe that is connected to a liquid connection pipe of the outdoor unit;
switching units that each:
correspond respectively to indoor units in the air conditioner, and
comprise valves that control refrigerant flows; and
a casing accommodating: the first header pipe, the second header pipe, the third header pipe, and the switching units, wherein
the refrigerant flow path switching device switches among refrigerant flow paths, each of which is between the outdoor unit and one of the indoor units,
an end of the first header pipe, an end of the second header pipe, and an end of the third header pipe project outward from the casing and are aligned linearly in a first direction, the first direction being a height direction of the refrigerant flow path switching device,
the valves are disposed apart from the end of the first header pipe in a second direction that is perpendicular to both of the first direction and a direction in which the end of the first header pipe extends, and
the valves include:
a first valve connected to the first header pipe via a first refrigerant tube; and
a second valve connected to the second header pipe via a second refrigerant tube and that is disposed at a same position in the first direction as the first valve.

2. The refrigerant flow path switching device according to claim 1, wherein
each of the switching units comprises a utilization gas pipe and a utilization liquid pipe that are connected to one of the indoor units, and
in the second direction, the utilization gas pipe and the utilization liquid pipe extend oppositely from the valves beyond all of the first header pipe, the second header pipe, and the third header pipe.

3. The refrigerant flow path switching device according to claim 1, wherein
the first refrigerant tube comprises a filter that removes foreign matter in a refrigerant.

4. The refrigerant flow path switching device according to claim 1, wherein
the first refrigerant tube comprises:
a first portion that extends from the first header pipe and extends oppositely from the first valve in the second direction; and
a second portion that extends from the first portion toward the first valve and connects to the first valve.

5. The refrigerant flow path switching device according to claim 4, wherein
the first header pipe is disposed on a same side of the second header pipe and the third header pipe in the first direction,
the first portion extends obliquely with respect to the first direction and farther away in the first direction from the second header pipe and the third header pipe, and
an end of the first portion farthest in the first direction from the first header pipe is disposed at a same position in the first direction as an end, in the first direction, of any one of the valves disposed farthest in the first direction.

6. The refrigerant flow path switching device according to claim 1, wherein
both ends of the third header pipe are aligned in the first direction with both ends of the first header pipe and both ends of the second header pipe, and
a portion of the third header pipe is disposed outside of the valves of the switching units when viewed in the first direction.

7. The refrigerant flow path switching device according to claim 6, wherein the third header pipe is disposed between the first header pipe and the second header pipe in the first direction.

8. The refrigerant flow path switching device according to claim 1, wherein the casing has a rectangular shape having a space therein that has:
both ends in the second direction defined by:
an end header pipe disposed farthest in the first direction among the first header pipe, the second header pipe, and the third header pipe, and
an adjacent valve most adjacent to the end header pipe in the second direction among the valves, and
both ends in the first direction defined by:
a refrigerant tube that connects the end header pipe with the adjacent valve, and
a wall of the casing in the first direction.

9. An air conditioning system comprising:
the refrigerant flow path switching device according to claim 1; and
an air conditioner that comprises:
the outdoor unit; and
the indoor units.

10. The refrigerant flow path switching device according to claim 1, wherein
each of the switching units comprises a utilization gas pipe that is connected to one of the indoor units, and
the utilization gas pipe comprises:

a first portion connected to the second valve and that extends from the second valve in the second direction; and a second portion bent from the first portion in the first direction and connected to a third refrigerant tube that extends from the first valve in the first direction.

* * * * *